US008128523B2

(12) United States Patent
Laliberty et al.

(10) Patent No.: US 8,128,523 B2
(45) Date of Patent: Mar. 6, 2012

(54) SPORTSBALL WITH IMPROVED SPIRAL ROTATION

(75) Inventors: Ronald P. Laliberty, Dudley, MA (US); Michael W. Maziarz, Wilbraham, MA (US)

(73) Assignees: Russell Asset Management, Inc., Wilmington, DE (US); SGG Patents LLC, Atlanta, GA (US)

( * ) Notice: Subject to any disclaimer, the term of this patent is extended or adjusted under 35 U.S.C. 154(b) by 388 days.

(21) Appl. No.: 12/435,556

(22) Filed: May 5, 2009

(65) Prior Publication Data

US 2009/0286632 A1 Nov. 19, 2009

Related U.S. Application Data

(60) Provisional application No. 61/053,061, filed on May 14, 2008.

(51) Int. Cl.
*A63B 41/00* (2006.01)

(52) U.S. Cl. ..... 473/603; 473/613; 273/DIG. 20

(58) Field of Classification Search ..... 473/594, 473/603, 613, 599; 273/DIG. 20
See application file for complete search history.

(56) References Cited

U.S. PATENT DOCUMENTS

| | | | | | |
|---|---|---|---|---|---|
| 1,505,802 | A | * | 8/1924 | Pierce | 473/603 |
| 1,518,448 | A | * | 12/1924 | Pierce | 473/599 |
| 1,597,308 | A | | 8/1926 | Brandt | |
| 2,244,503 | A | * | 6/1941 | Riddell | 473/597 |
| 2,364,247 | A | | 12/1944 | Shearer | |
| 3,884,466 | A | * | 5/1975 | MacDonald et al. | 473/613 |
| 3,887,416 | A | * | 6/1975 | Tebbetts, Jr. | 156/156 |
| 4,003,574 | A | * | 1/1977 | MacDonald et al. | 473/613 |
| 4,917,381 | A | | 4/1990 | Spector | |
| 4,998,728 | A | * | 3/1991 | Traub | 473/605 |
| 5,000,451 | A | | 3/1991 | MacDonald et al. | |
| 5,098,097 | A | | 3/1992 | Kennedy et al. | |
| 5,123,645 | A | | 6/1992 | MacDonald et al. | |
| 5,224,704 | A | * | 7/1993 | Snell | 473/604 |
| 5,228,687 | A | * | 7/1993 | Luecke et al. | 473/596 |
| 5,261,661 | A | | 11/1993 | Lemmon | |
| 5,342,043 | A | | 8/1994 | Baltronis et al. | |
| 5,480,144 | A | * | 1/1996 | Downing | 473/599 |
| 5,984,806 | A | | 11/1999 | Sullivan et al. | |

* cited by examiner

*Primary Examiner* — Steven Wong
(74) *Attorney, Agent, or Firm* — Richard M. Klein; Fay Sharpe LLP

(57) ABSTRACT

A sportsball, such as a football, is preferentially constructed to enhance spiral rotation when thrown or kicked, allowing enhanced stability and distance.

20 Claims, 5 Drawing Sheets

SPORTSBALL WITH IMPROVED SPIRAL ROTATION

CROSS-REFERENCE TO RELATED APPLICATIONS

This application claims priority to U.S. Provisional Patent Application Ser. No. 61/053,061, filed May 14, 2008. That application is hereby fully incorporated by reference herein.

BACKGROUND

The present disclosure relates generally to an inflatable, substantially oval or oblong sportsball, such as a football, for competitive play. In particular, the football is configured so that it has improved spiral rotation when thrown, kicked, etc.

A football is an inflated oval ball made of a bladder encased usually in leather, rubber, or plastic. It is used for throwing and kicking in the games of rugby and football, such as American style or Canadian football.

A football has a generally prolate spheroid shape defined by a major axis and a minor axis, with lacing on one side of the ball. To obtain maximum distance and/or precision, a football is preferably thrown to rotate about its major axis. Such spiral rotation increases the stability of the football's flight path and the distance traveled for a given amount of energy. However, throwing a spiral is a somewhat difficult skill to learn and/or reproduce repetitively. A poorly thrown ball is evident in its wobbly flight, travels a shorter distance than could otherwise be obtained, is less accurate, and is more difficult to catch.

A sportsball that can enhance the distance thrown, kicked, etc. and improve the desired flight path, even when thrown, kicked etc. by one of lesser skill, is desirable.

BRIEF DESCRIPTION

Disclosed, in various embodiments, are non-uniformly configured sportsballs, such as perimeter weighted footballs. The sportsballs can spiral better when launched, thereby increasing their potential travel distance and/or accuracy. Methods of making and/or using such sportsballs are also disclosed.

In embodiments, a sportsball is disclosed having a major axis and a minor axis. Two planes which are perpendicular to the major axis are located equally distant from the center of the major axis so as to divide the sportsball into a middle portion and two end portions. The middle portion has a middle portion weight and a middle portion length, and each end portion has an end portion weight and an end portion length. The ratio of (middle portion weight/middle portion length) to (end portion weight/end portion length) is at least 2, including 2.1.

In further embodiments, the ratio of (middle portion weight/middle portion length) to (end portion weight/end portion length) for the sportsball may be at least 2.2, at least 2.5, or from 2 to about 2.5.

In still other embodiments, a sportsball is disclosed which has a major axis and a minor axis. Two planes which are perpendicular to the major axis are located equally distant from the center of the major axis so as to divide the sportsball into a middle portion and two end portions. The middle portion has a middle portion weight and a middle portion length, and each end portion has an end portion weight and an end portion length. The ratio of the middle portion length to the end portion length is from about 0.5 to about 0.95; and the weight of the middle portion is at least 1.5 times greater than the weight of one end portion.

In further embodiments, the weight of the middle portion may be at least two times greater, at least four times greater, about five times greater, or from two times greater to about five time greater, than the weight of one end portion.

In still more embodiments, a football is disclosed which has a major axis and a minor axis. Two planes which are perpendicular to the major axis are located equally distant from the center of the major axis so as to divide the football into a middle portion and two end portions. The middle portion has a middle portion weight and a middle portion length, and each end portion has an end portion weight and an end portion length. The ratio of the middle portion length to the end portion length is from about 0.5 to about 0.95; and the weight of the middle portion is at least 45% of the total weight of the football.

In further embodiments, the weight of the middle portion may be at least 50%, at least 65%, or at least 70% of the total weight of the football.

In additional embodiments, a bladder for a sportsball is disclosed having a major axis and a minor axis. Two planes which are perpendicular to the major axis are located equally distant from the center of the major axis so as to divide the sportsball bladder into a middle portion and two end portions. The middle portion has a middle portion weight and a middle portion length, and each end portion has an end portion weight and an end portion length. The ratio of (middle portion weight/middle portion length) to (end portion weight/end portion length) is at least 3.

In other embodiments, the ratio of (middle portion weight/middle portion length) to (end portion weight/end portion length) for the bladder may be at least 5 or at least 5.5.

In still other embodiments, a bladder is disclosed which has a major axis and a minor axis. Two planes which are perpendicular to the major axis are located equally distant from the center of the major axis so as to divide the bladder into a middle portion and two end portions. The middle portion has a middle portion weight and a middle portion length, and each end portion has an end portion weight and an end portion length. The ratio of the middle portion length to the end portion length is from about 0.5 to about 0.95; and the weight of the middle portion is at least four times greater than the weight of one end portion.

In further embodiments, the weight of the middle portion may be about five times greater than the weight of one end portion.

In yet other embodiments, a bladder is disclosed which has a major axis and a minor axis. Two planes which are perpendicular to the major axis are located equally distant from the center of the major axis so as to divide the bladder into a middle portion and two end portions. The middle portion has a middle portion weight and a middle portion length, and each end portion has an end portion weight and an end portion length. The ratio of the middle portion length to the end portion length is from about 0.5 to about 0.95; and the weight of the middle portion is at least 65% of the total weight of the bladder.

In further embodiments, the weight of the middle portion may be at least 70% of the total weight of the bladder.

In alternative embodiments, a casing for a sportsball is disclosed which has a major axis and a minor axis. Two planes which are perpendicular to the major axis are located equally distant from the center of the major axis so as to divide the casing into a middle portion and two end portions. The middle portion has a middle portion weight and a middle portion length, and each end portion has an end portion weight and an end portion length. The ratio of (middle portion weight/middle portion length) to (end portion weight/end portion length) is at least 3.

In further embodiments, the ratio of (middle portion weight/middle portion length) to (end portion weight/end portion length) for the casing may be at least 5 or at least 5.5.

In still other embodiments, a casing is disclosed which has a major axis and a minor axis. Two planes which are perpendicular to the major axis are located equally distant from the center of the major axis so as to divide the casing into a middle portion and two end portions. The middle portion has a middle portion weight and a middle portion length, and each end portion has an end portion weight and an end portion length. The ratio of the middle portion length to the end portion length is from about 0.5 to about 0.95; and the weight of the middle portion is at least four times greater than the weight of one end portion.

In further embodiments, the weight of the middle portion may be about five times greater than the weight of one end portion.

In yet further embodiments, a casing is disclosed which has a major axis and a minor axis. Two planes which are perpendicular to the major axis are located equally distant from the center of the major axis so as to divide the casing into a middle portion and two end portions. The middle portion has a middle portion weight and a middle portion length, and each end portion has an end portion weight and an end portion length. The ratio of the middle portion length to the end portion length) is from about 0.5 to about 0.95; and the weight of the middle portion is at least 65% of the total weight of the casing.

In further embodiments, the weight of the middle portion may be at least 70% of the total weight of the casing.

Sportsballs, such as footballs comprising the above-mentioned bladder and/or casing are also disclosed.

Some methods of forming the disclosed bladder comprise adding a high-density filler to the middle portion of the bladder. Other methods of forming the disclosed bladder comprise adding an extra layer to the middle portion of the bladder, wherein the extra layer is made of a material having a higher density than the material from which the bladder is made.

Yet other methods of forming the disclosed bladder comprise: providing a first bladder layer and a second bladder layer, the second bladder layer being dimensioned so as to fit inside the first bladder layer; joining the first bladder layer and second bladder layer using one or more seams so as to form at least one pocket; and filling the pocket with a high-density material.

Some methods of forming the disclosed casing comprise adding an extra layer to the middle portion of the casing, wherein the extra layer is made of a high-density material that increases the weight of the middle portion of the casing compared to one end portion of the casing. Yet other methods of forming the disclosed casing comprise tapering the casing so the middle portion of the casing has a thickness which is greater than the thickness of one end portion of the casing. The tapering may be at a constant rate, or include a sharp transition.

Disclosed in other embodiments is a sportsball having a major axis and a minor axis. Two planes which are perpendicular to the major axis are located equally distant from the center of the major axis so as to divide the sportsball into a middle portion and two end portions. The middle portion has a middle portion weight and a middle portion length, and each end portion has an end portion weight and an end portion length. The ratio of (middle portion weight/middle portion length) to (end portion weight/end portion length) is at least 2, including at least 2.1, or at least 2.5.

The middle portion length may be from about 2.5 inches to about 3.5 inches. The ratio of the middle portion length to one end portion length may be from about 0.5 to about 0.95.

To increase the weight of the middle portion, the middle portion may comprise a plurality of weighted strips surrounding a bladder. Each weighted strip may have a uniform thickness along its length and width.

Disclosed in other embodiments is a sportsball having a major axis and a minor axis. Two planes which are perpendicular to the major axis are located equally distant from the center of the major axis so as to divide the sportsball into a middle portion and two end portions. The middle portion has a middle portion weight and a middle portion length, and each end portion has an end portion weight and an end portion length. The ratio of the middle portion length to one end portion length is from about 0.5 to about 0.95; and the weight of the middle portion is at least 1.5 times greater than the weight of one end portion.

The weight of the middle portion may also be at least four times greater than the weight of one end portion, or from at least two times greater to about five times greater than the weight of one end portion.

The ratio of (middle portion weight/middle portion length) to (end portion weight/end portion length) may be at least 2.

The middle portion length may be from about 2.5 inches to about 3.5 inches.

The middle portion may comprise a plurality of weighted strips surrounding a bladder. Each weighted strip may have a uniform thickness along its length and width.

Also disclosed in embodiments is a sportsball having a major axis and a minor axis. Two planes which are perpendicular to the major axis are located equally distant from the center of the major axis so as to divide the sportsball into a middle portion and two end portions. The middle portion has a middle portion weight and a middle portion length, and each end portion has an end portion weight and an end portion length. The ratio of the middle portion length to one end portion length is from about 0.5 to about 0.95; and the weight of the middle portion is at least 45% of the total weight of the sportsball.

The weight of the middle portion may be at least 65%, or even 70%, of the total weight of the sportsball bladder.

The middle portion length may be from about 2.5 inches to about 3.5 inches.

The middle portion may comprise a plurality of weighted strips surrounding a bladder. Each weighted strip may have a uniform thickness along its length and width.

These and other non-limiting characteristics are more particularly described below.

BRIEF DESCRIPTION OF THE DRAWINGS

The following is a brief description of the drawings, which are presented for the purpose of illustrating the exemplary embodiments disclosed herein and not for the purpose of limiting the same.

DETAILED DESCRIPTION

Figure 1:
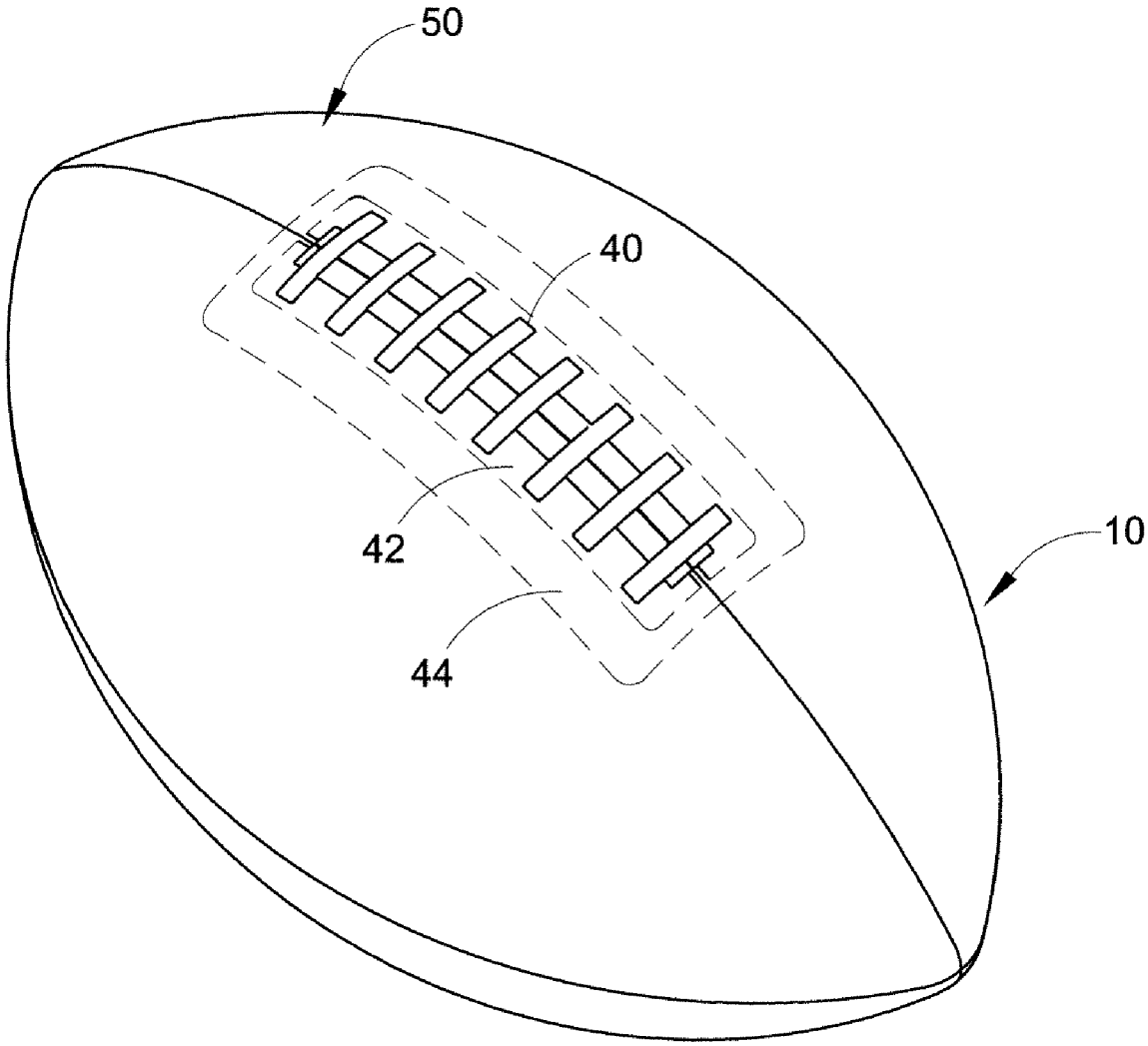
FIG. 1 is an exterior view of a typical American styled football.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Current American styled footballs may be constructed with an inflatable, generally prolate spheroid shaped bladder. The bladder is covered by a cover layer usually made from four generally oval-shaped panels which are sewn, stitched, or seamed together along their edges. If desired, additional layers may be placed between the bladder and the cover layer by the use of additional oval-shaped panels. For example, a foam layer and/or a cloth layer may also be present. One of the seams is not stitched along a central extent, thereby forming an opening to allow the bladder to be inserted within the cover layer during fabrication. After insertion, the opening is closed by the use of lacing and associated components, such as a lacing liner placed to prevent the lacing from contacting the bladder.

Another means of constructing a football is through molding. Briefly, a bladder is inserted into a molding assembly along with a seam material. The molding assembly applies heat and/or pressure to mold the seam material into a cover layer having outwardly projecting seams. Cover panels are then laid in the areas between seams and lacing is applied to finish the football. This method of construction is more completely described in U.S. Patent Publication No. 2007/0129188, the disclosure of which is hereby fully incorporated by reference herein.

Figure 2:
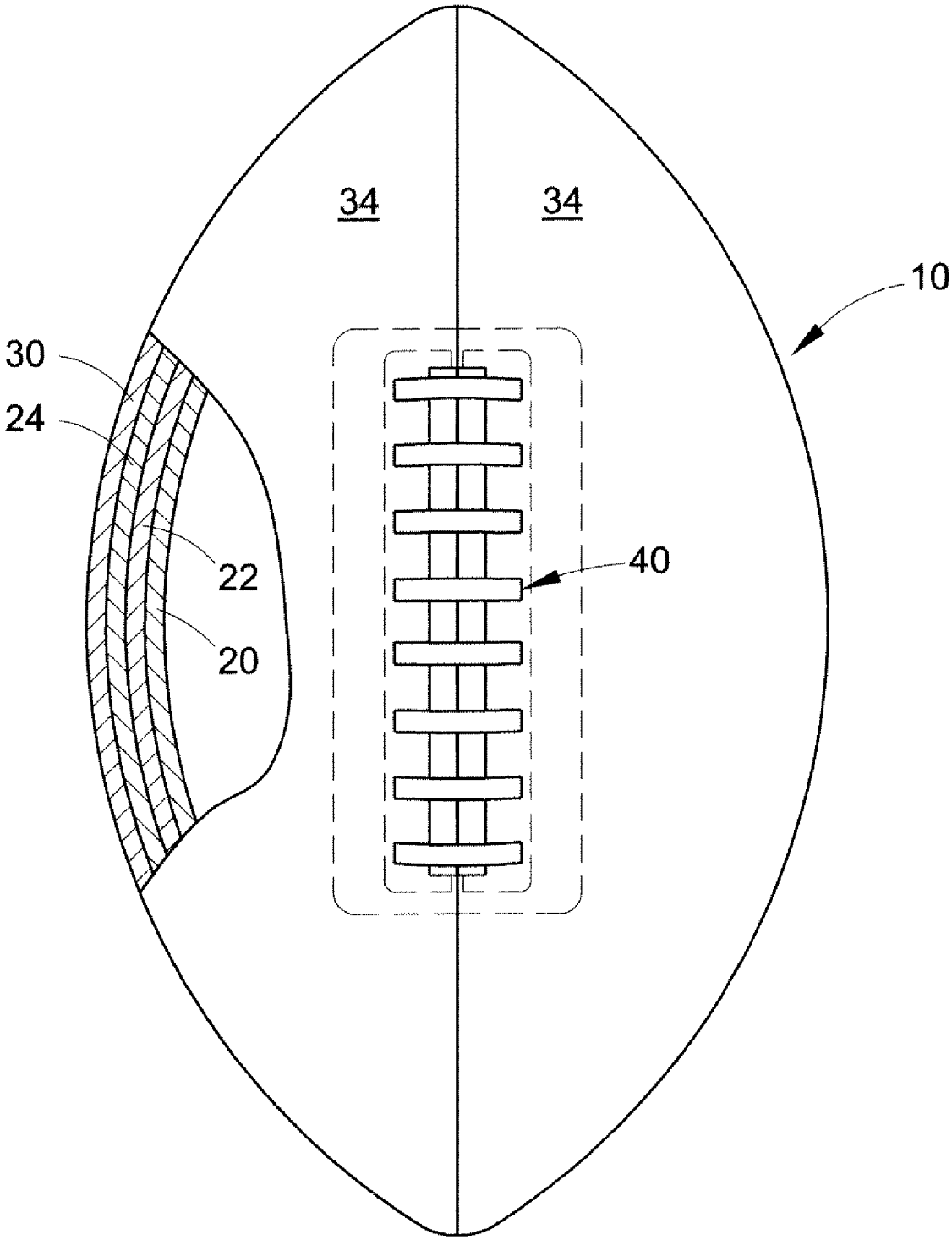
FIG. 2 is a cross-sectional view of the same football.

FIG. 1 is an exterior view of a typical American football 10. FIG. 2 is a cross-sectional view of the same football 10. The bladder 20 is inside the football casing 50. Surrounding the bladder 20 is a cloth liner 22, then a foam liner 24, then the cover layer 30. The cloth liner, foam liner, and cover layer are generally combined to make a panel 34; four panels 34 make up the football casing 50 and are used to cover the football 10. The four panels are joined together by stitching at three edges and by a combination of stitching and lacing at the fourth edge. The lacing area includes the lacing 40, a patch material 42 stitched to the underside of panels 34 through which lacing 40 penetrates, and a tongue 44 located between the bladder 20 and the lacing 40 which has penetrated the patch material 42. The lacing, patch material, and tongue cause the football to be asymmetrically weighted.

For purposes of this application, the term "weighted football" refers to the football without the lacing, patch material, and tongue. Put another way, the term "weighted football" refers to the combination of bladder and football casing and excludes the lacing, patch material, and tongue. The term "weighted football" also excludes any incidental weight due to air within the bladder. Weighted footballs are generally symmetrically weighted about the major axis of the football.

The term "bladder" refers to the balloon located inside a football for the purpose of containing air and the layer(s) that make up that balloon. Again, the weight of any air in the bladder would not be included.

The term "football casing" refers to the material which surrounds the bladder, excluding the lacing, patch material, and tongue. For example, the combination of four panels 34 is considered a football casing. As another example, when the football is made by molding, the cover layer having outwardly projecting seams plus the cover panels is considered a football casing.

The weighted footballs of the present disclosure are weighted so that the middle of the weighted football is significantly heavier than the ends. This weight distribution aids the spiraling motion of the football, enhancing stability and traveling distance. The concentration of weight in the middle increases the moment of inertia about the weighted football's major axis, which helps improve the rotation of the football around that axis.

Several standards for footballs are shown in the following Table 1:

TABLE 1

| Standard | Pee-Wee Football | Junior Size Football | Full Size Football | NCAA Football | NFL Football | CFL Football |
|---|---|---|---|---|---|---|
| Minimum Minor Axis Circumference (cm) | 44.5 | 47 | 52.7 | 52.7 | 53.3 | 53.0 |
| Maximum Minor Axis Circumference (cm) | 46 | 48.3 | 54 | 54.0 | 54.0 | 53.7 |
| Minimum Major Axis Circumference (cm) | 60 | 64.6 | 70.8 | 70.5 | 71.1 | 70.5 |
| Maximum Major Axis Circumference (cm) | 61.5 | 65.9 | 72.9 | 71.8 | 72.4 | 71.8 |
| Minimum Length (cm) | 24 | 25.7 | 27.6 | 27.6 | 27.9 | 27.9 |
| Maximum Length (cm) | 25.5 | 26.7 | 29 | 28.4 | 28.6 | 28.6 |
| Minimum Weight (g) | 290 | 320 | 397 | 397 | 397 | 397 |
| Maximum Weight (g) | 320 | 350 | 425 | 425 | 425 | 425 |

The minor axis may also be referred to as the short axis or the girth. The length refers to the length of the major axis, which may also be referred to as the long axis. Generally, the footballs of the present disclosure will still meet these standards, although differing in the weight distribution.

Figure 3:
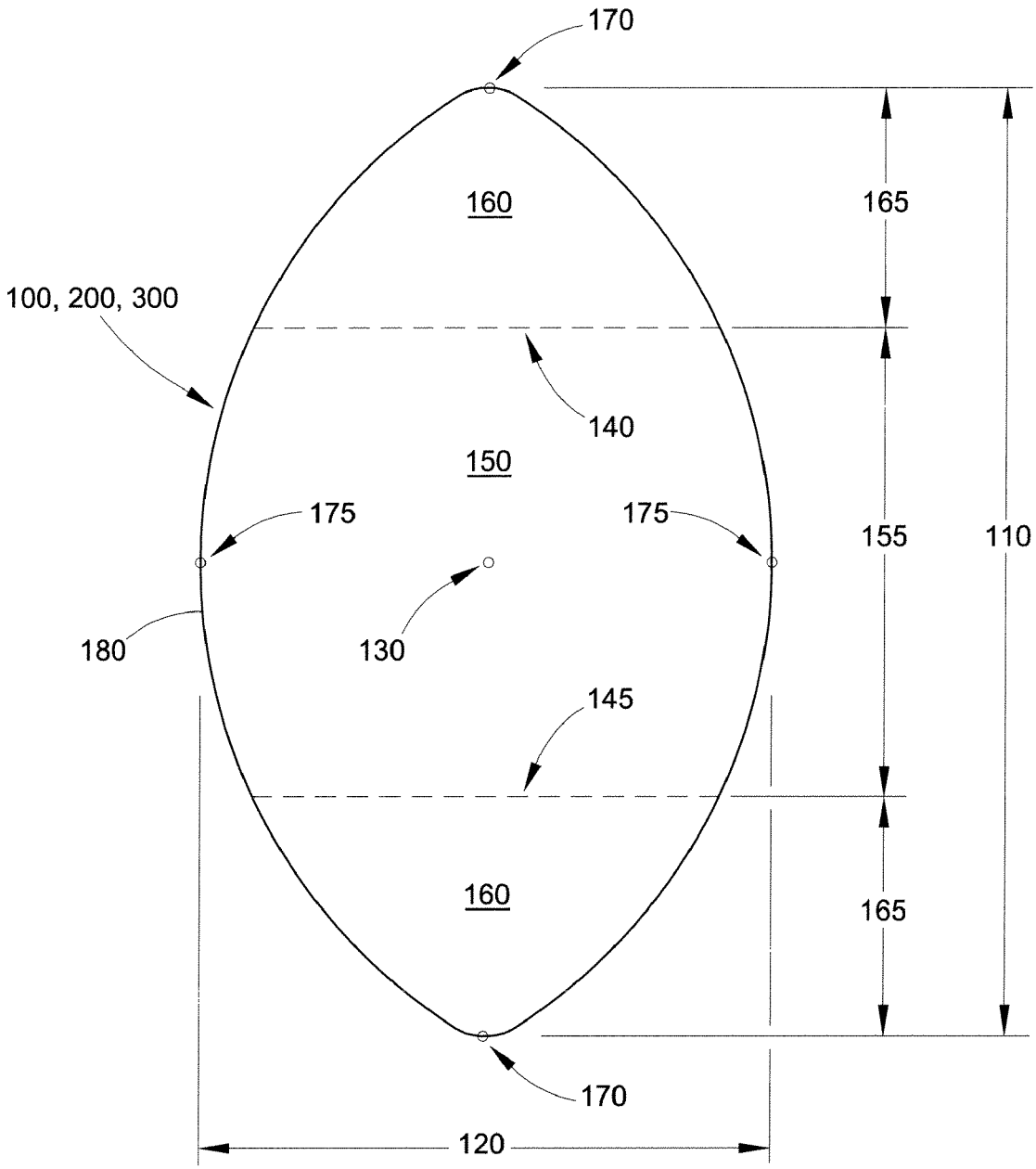
FIG. 3 is a cross-sectional diagram of a football, football bladder, or football casing of the present disclosure.

One method of making the weighted football of the present disclosure is by providing a bladder which is preferentially weighted in its middle portion. FIG. 3 is a cross-sectional diagram of a weighted football 100, football bladder 200, or football casing 300 of the present disclosure. All terms refer equally to the various aspects of the football, bladder, or casing.

The football, bladder, or casing has a major axis 110, a minor axis 120, and a generally elliptical cross-section. The major axis 110 and minor axis 120 intersect at the center 130 of the football, bladder, or casing. The center 130 is also the center of the major axis and the minor axis. Two imaginary planes 140, 145 are perpendicular to the major axis 110 and are located equally distant from the center 130. The two planes divide the football, bladder, or casing into a middle portion 150 and two end portions 160. The middle portion 150 has a middle portion weight 153, while each end portion 160 has an end portion weight 163. The two planes can also be considered as dividing the major axis 110 into a middle portion length 155 and two end portion lengths 165. In other words, the lengths are measured parallel to the major axis. The two planes 140, 145 are always located equidistant from the center 130 of the major axis. Put another way, the end portion lengths 165 are always the same. There are two ends 170 which are included in the end portions. The circle formed by the intersection of the minor axis with the surface of the football, bladder, or casing defines a surface center 175.

The football bladder may be weighted by providing a middle portion that has a higher weight per length value than the end portions. In embodiments, the football bladder has a ratio of (middle portion weight/middle portion length) to (end portion weight/end portion length) that is at least 3. In further embodiments, the ratio is at least 5 or at least 5.5. In some embodiments, the ratio may be at least 7 or even at least 8.

Alternatively, the ratio of (middle portion length/end portion length) for the bladder is from about 0.5 to about 0.95; and the weight of the middle portion is at least four times greater than the weight of one end portion. In further specific embodiments, the ratio of (middle portion length/end portion length) is from about 0.5 to about 0.95; and the weight of the middle portion is about five times greater than the weight of one end portion. In yet further embodiments, the ratio of (middle portion length/end portion length) is from about 0.5 to about 0.7, or from about 0.8 to about 0.95.

In yet other embodiments, the ratio of (middle portion length/end portion length) for the bladder is from about 0.5 to about 0.95; and the weight of the middle portion is at least 65% of the total weight of the football bladder. In more specific embodiments, the ratio of (middle portion length/end portion length) for the bladder is from about 0.5 to about 0.95; and the weight of the middle portion is at least 70% of the total weight of the football bladder. In other embodiments, the ratio of (middle portion length/end portion length) is from about 0.5 to about 0.7. In particular embodiments, the middle portion length is from about 2.5 inches to about 3.5 inches.

The bladder, when properly inflated, provides the primary resilience to a finished football. The bladder can be made from latex or butyl rubber and fitted with a valve stem (not shown) for introducing air into the ball as inflated pressure to the structure. Butyl rubber bladders retain air for longer periods of time and offer an excellent combination of contact quality and air retention. Latex bladders tend to provide better surface tension, give proper bounce, feel softer, and provide same angle rebounce characteristics. Natural latex rubber bladders usually offer the softest feel and response, but do not provide the best air retention because they contain micro-pores. Micro-pores are tiny holes that slowly allow air to escape. Balls with natural rubber bladders need to be reinflated (at least once a week) more often than balls with butyl bladders (stay properly inflated for weeks at a time) due to these micro-pores. Some balls use carbon-latex bladders, where carbon powder is added to the latex to plug some of the microscopic holes that are in pure latex bladders. Carbon latex bladders retain air longer than bladders made from latex rubber. Some manufacturers also use bladders made from multiple layers of polyurethane. The bladder can be of appropriate thickness as to reasonably protect against loss of air due to puncture, temperature change, or other foreseeable occurrences.

The additional weighting of the middle portion of the football bladder can be accomplished by several different means. Additional weight could be applied by, for example, adding a high-density filler, such as barium sulfate or a tungsten powder, to a polymer binder and forming the middle portion of the bladder from that high density polymer while the end portions are formed from a lower-density polymer. Similarly, additional strips, patches, or layers of higher-density material could be used to form the bladder. Some bladders are made as multi-layer concentric balloons (one balloon inside another balloon) which are joined to each other along seams that parallel the major axis. Additional seams could be used to form pockets within the bladder between balloons which are then filled with a high-density filler or liquid as well. In particular embodiments, two or more weighted strips or patches are placed around the middle portion of the bladder. The weighted strips surround the bladder, or in other words extend around the circumference of the middle portion. The gaps between the weighted strips may be located at the seams of the bladder to allow for expansion as the bladder is inflated. The thickness of the weighted strips can vary, being thickest near the middle and tapering off as they progress towards an end 170 or end portion of the bladder. The tapering may be gradual (i.e. at a constant rate from surface center 175 to end 170) or sharp (i.e., transitioning immediately from one thickness to a second thickness, such as near or at the intersection of the surface with the two planes 140, 145). Generally, the weighted strips have a uniform thickness along their entire length and width.

The fact that the middle portion is weighted compared to the end portions should not be construed as requiring the middle portion to be evenly or homogeneously weighted throughout its entirety.

Another method of making the weighted football of the present disclosure is by providing a football casing which is preferentially weighted in its middle portion. Again, the football casing has the major axis 110, a minor axis 120, center 130, two imaginary planes 140, 145, middle portion 150 and two end portions 160, middle portion weight 153, end portion weight 163, middle portion length 155, and two end portion lengths 165 as described in FIG. 3.

The football casing may be weighted by providing a middle portion that has a higher weight per length value than the end portions. In embodiments, the football casing has a ratio of (middle portion weight/middle portion length) to (end portion weight/end portion length) that is at least 3. In further embodiments, the ratio is at least 5 or at least 5.5. In other embodiments, the ratio may be at least 7 or even at least 8.

Alternatively, the ratio of (middle portion length/end portion length) for the casing is from about 0.5 to about 0.95; and the weight of the middle portion is at least four times greater than the weight of one end portion. In further specific embodiments, the ratio of (middle portion length/end portion length)

is from about 0.5 to about 0.95; and the weight of the middle portion is about five times greater than the weight of one end portion. In yet further embodiments, the ratio of (middle portion length/end portion length) is from about 0.5 to about 0.7, or from about 0.8 to about 0.95.

In yet other embodiments, the ratio of (middle portion length/end portion length) for the casing is from about 0.5 to about 0.95; and the weight of the middle portion is at least 65% of the total weight of the football casing. In more specific embodiments, the ratio of (middle portion length/end portion length) for the casing is from about 0.5 to about 0.95; and the weight of the middle portion is at least 70% of the total weight of the football casing. In particular embodiments, the middle portion length is from about 2.5 inches to about 3.5 inches.

The cover layer of the football casing is generally made from different materials, such as leather and composite material. Leather is generally used by professional athletes, and is considered best for grip, feel, and control. One disadvantage of a leather cover on a football is that the ball can be damaged if scraped against a hard surface like asphalt or concrete. Composite footballs generally attempt to simulate the look and feel of a real leather ball. They can be made of polyurethane (PU) or polyvinyl chlorides (PVC), natural or synthetic rubbers, synthetic composites, microfiber composites, etc. Some advantages of a composite cover are that they are durable and less expensive than a leather cover. Synthetic leather can also be made by, for example, impregnating a fibrous mat made from nylon or polyester with a coating resin such as thermoplastic rubbers, natural rubber, polyether urethanes, metallocene polyethylenes, polyureas, PVC plastisols, EPDM rubber, and the like. Some synthetic leathers suitable for the cover layer include those described in U.S. Pat. No. 5,669,838, the contents of which are hereby fully incorporated by reference herein.

The foam layer and cloth layer may also be formed from materials known in the art. For example, the foam layer can be made from styrene butadiene rubber (SBR); polybutadiene rubbers; polyurethane foams; ethylene vinyl acetate (EVA) foams; polypropylene foams; ethylene propylene diene monomer (EPDM); and combinations and blends thereof.

The additional weighting of the middle portion of the football casing can be accomplished by several different means. Additional strips, patches, or layers of higher-density material, made by incorporating high-density fillers into a polymeric binder, may be placed as needed to change the weight distribution. The thickness of the various layers could vary, being thickest near the middle and tapering off as the layer progresses to an end 170 of the casing. The tapering may be gradual (i.e. at a constant rate from surface center 175 to end 170) or sharp (i.e., transitioning immediately from one thickness to a second thickness, such as near or at the intersection of the surface with the two planes 140, 145). Again, weighted strips may be part of the football casing, and the weighted strips surround the bladder. In embodiments, two or more weighted strips are used. Typically, four weighted strips are used as the football casing is generally made from four separate panels. A weighted strip is located on each panel. Generally, the weighted strips have a uniform thickness along their entire length and width.

Again, the fact that the middle portion is weighted compared to the end portions should not be construed as requiring the middle portion to be evenly or homogeneously weighted throughout its entirety.

A weighted football of the present disclosure could thus be made from a combination of: (a) weighted bladder plus normal football casing; (b) normal bladder plus weighted football casing; and (c) weighted bladder plus weighted football casing. Again, the weighted football has the major axis 110, a minor axis 120, center 130, two imaginary planes 140, 145, middle portion 150 and two end portions 160, middle portion weight 153, end portion weight 163, middle portion length 155, and two end portion lengths 165 as described in FIG. 3. The middle portion of the weighted football would include the middle portion of the bladder and the middle portion of the football casing.

In embodiments, the weighted football has a ratio of (middle portion weight/middle portion length) to (end portion weight/end portion length) that is at least 2, including 2.1. In further embodiments, the ratio is at least 2.2, at least 2.5, or from at least 2 to about 2.5.

Alternatively, the ratio of (middle portion length/end portion length) for the weighted football is from about 0.5 to about 0.95; and the weight of the middle portion is at least 1.5 times greater than the weight of one end portion. In further specific embodiments, the ratio of (middle portion length/end portion length) is from about 0.5 to about 0.95; and the weight of the middle portion is at least 2 times greater, at least four times greater, or about five times greater than the weight of one end portion. In another embodiment, the ratio of (middle portion length/end portion length) is from about 0.5 to about 0.95; and the weight of the middle portion is from at least 2 times greater to about five times greater than the weight of one end portion. In yet further embodiments, the ratio of (middle portion length/end portion length) is from about 0.5 to about 0.7, or from about 0.8 to about 0.95.

In yet other embodiments, the ratio of (middle portion length/end portion length) for the weighted football is from about 0.5 to about 0.95; and the weight of the middle portion is at least 45% of the total weight of the weighted football. In more specific embodiments, the ratio of (middle portion length/end portion length) for the casing is from about 0.5 to about 0.95; and the weight of the middle portion is at least 50%, at least 65%, or at least 70% of the total weight of the weighted football. In other embodiments, the ratio of (middle portion length/end portion length) is from about 0.5 to about 0.7. In particular embodiments, the middle portion length is from about 2.5 inches to about 3.5 inches.

Figure 4:
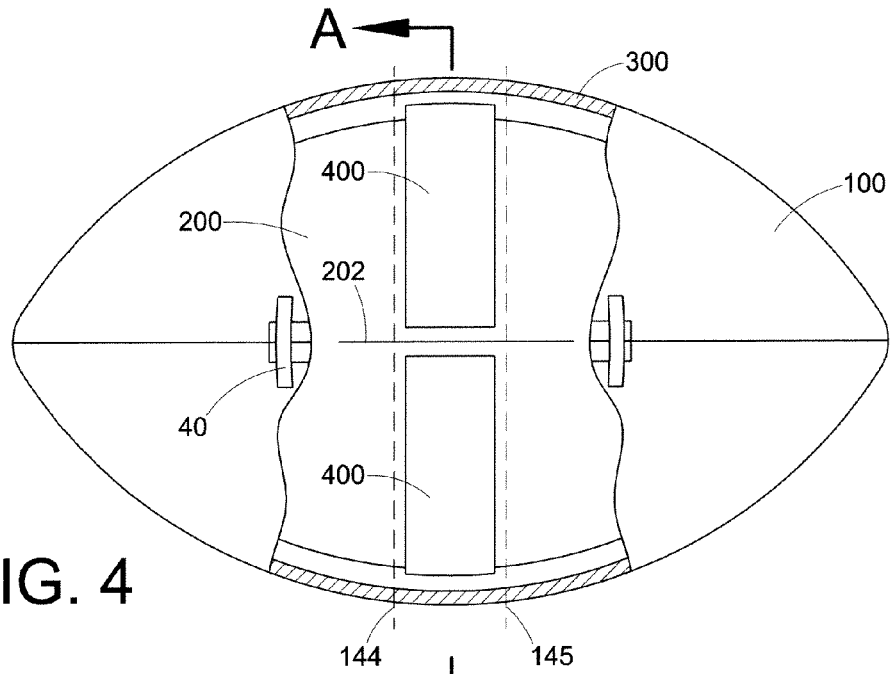
FIG. 4 is a simplified cross-sectional view from the top of a sportsball of the present disclosure.
Figure 5:
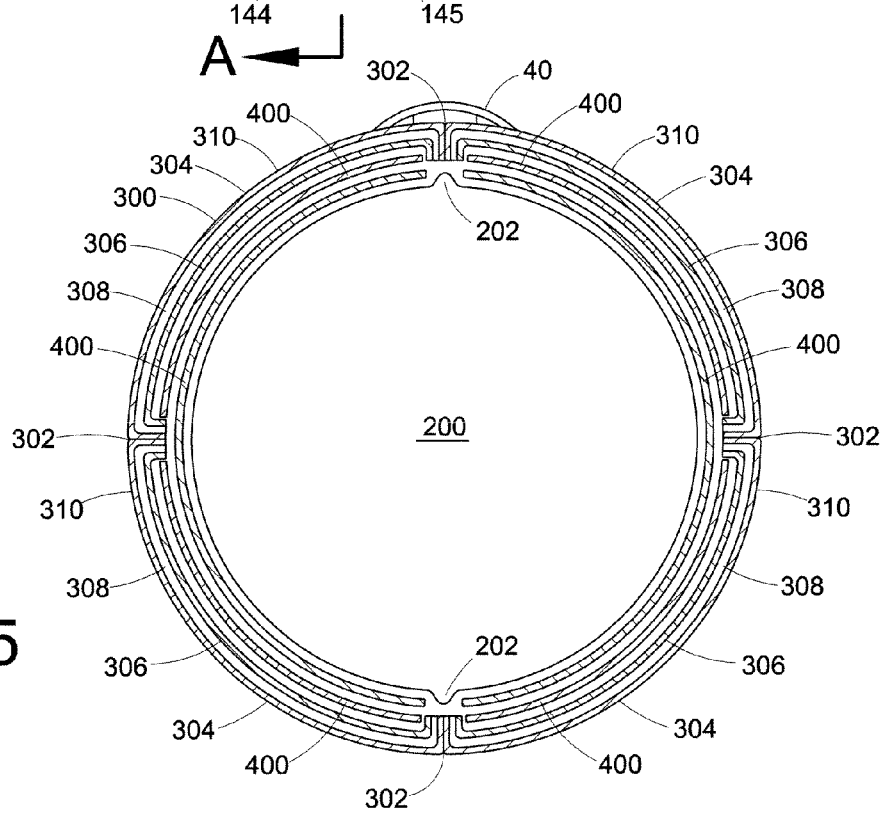
FIG. 5 is a simplified cross-sectional view from one end of a sportsball of the present disclosure, i.e. along line A-A of FIG. 4.

FIGS. 4 and 5 illustrate a weighted football having both a weighted bladder and a weighted football casing. FIG. 4 is a simplified cross-sectional view from the top (i.e. through the lacing) of the weighted football 100, while FIG. 5 is a simplified cross-sectional view from one end of the weighted football 100 along line A-A of FIG. 4. The bladder 200 has two seams 202 generally oriented at the top (i.e. where the lacing 40 is placed) and bottom. Two weighted strips 400 are placed around the bladder, with the gaps located with the bladder seams 202. As seen in FIG. 4, the weighted strips 400 are located in the middle portion of the football, with imaginary planes 140, 145 shown for reference. The football casing 300 surrounds the bladder, and is made from four panels 304. Each panel 304 includes a cloth liner 306, a foam liner 308, and a cover layer 310. Four weighted strips 400 are present, one on each panel, shown here as being attached to the cloth liner 306 on the side facing the bladder 200. The gaps between the weighted strips are located with the panel seams 302. However, the weighted strips could be placed between any layer of the panel 304 as desired. In addition, not all layers in the panel 304 are required. For example, in some embodiments, no foam liner 308 is included.

The weighted strips 400 can be considered part of the bladder or part of the casing, depending on how the football is manufactured. For example, in some embodiments, the bladder is made from a plurality of elastomeric layers, and weighted strips are located between adjacent elastomeric layers. For example, in a bladder made from four layers of polyurethane film, the weighted strips are placed between the second and third layers of film.

Figure 6:
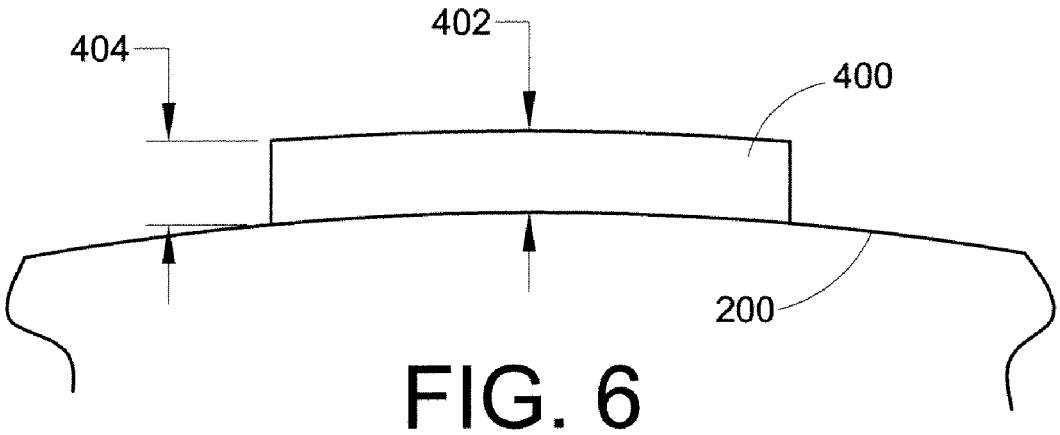
FIG. 6 illustrates the thickness of one variation of a weighted strip located in a weighted football of the present disclosure.
Figure 7:
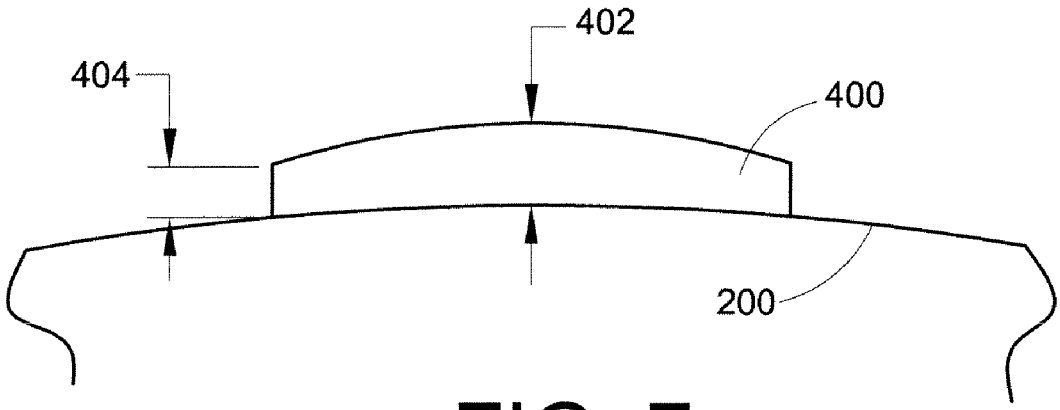
FIG. 7 illustrates the thickness of another variation of a weighted strip located in a weighted football of the present disclosure.

FIGS. 6 and 7 show two variations of the weighted strip 400. In one variation shown in FIG. 6, the weighted strip has a relatively constant thickness, with the middle height 402 being about equal to the end height 404. In the variation shown in FIG. 7, the weighted strip tapers towards each end of the football, with the middle height 402 being greater than the end height 404.

The weighted strip(s) may have a length of from about 3.0 to about 7.0 inches. The strip(s) may have a width of from about 1.5 inches to about 3.5 inches, particularly a width of from about 2.5 inches to about 3.5 inches, or about 2.75 inches. The strip(s) may have a thickness of from about 0.01 inches to about 0.3 inches, particularly about 0.05 inches. Each strip may have a weight of from about 5 grams to about 25 grams, particularly from about 10 grams to about 20 grams. They are used in a quantity sufficient to add a weight of about 80 to about 90 grams to the middle section of the weighted football. Please note that the length and width orientations for the weighted strip do not necessarily correlate with the length and width orientations for the weighted football, bladder, or casing.

The weighted strips, when used on the bladder, may more particularly have a length of about 6 to about 7 inches and a width of from about 1.5 to about 2 inches. Each strip may weigh about 20 grams.

The weighted strips, when used on the football casing, may more particularly have a length of about 3 to about 4 inches and a width of from about 1.5 to about 2 inches. Each strip may weigh about 10 grams.

In some particular embodiments, the weighted football uses two weighted strips on the bladder and four weighted strips on the football casing.

The following example is provided to illustrate the weighted footballs and methods of the present disclosure. The examples are merely illustrative and are not intended to limit the disclosure to the materials, conditions, or process parameters set forth therein.

EXAMPLE

A weighted football bladder is made and is combined with a conventional or "normal" football casing. The football bladder has a major axis length of 11.5 inches and a total weight of 166.4 grams. The end portion has a length of 4.0 inches and a weight of 24.0 grams. The middle portion has a length of 3.5 inches and a weight of 118.4 grams. The football casing has a total weight of 196.4 grams. The football itself has a total weight of 410.0 grams. The discrepancy in weight is attributed to the lacing and components which are not considered for the weighted football.

Next, a weighted football casing is made and is combined with a "normal" football bladder. Again, the bladder has a total weight of 166.4 grams and the weighted casing has a total weight of 196.4 grams. The weight distribution of the football casing is the same as that of the weighted football bladder described above.

For the "normal" bladder and casing, it is assumed that the weight is distributed evenly along the length of the major axis. For the weighted casing, it is assumed that the weight is distributed in the same ratio as in the weighted bladder. Table 2 provides the various ratios for these weighted football bladders, skins, and footballs.

TABLE 2

| Weighted Bladder or Weighted Football Casing | Weight (g) | Length (in) | Length (cm) | Weight per Length (g/cm) |
|---|---|---|---|---|
| End | 24 | 4 | 10.16 | 2.36 |
| Middle Portion | 118.4 | 3.5 | 8.89 | 13.32 |
| Weight/Weight Ratio (Middle/End) | 4.93 | | | |
| Weight/Length Ratio (Middle/End) | 5.64 | | | |
| Length/Length Ratio (Middle/End) | 0.88 | | | |

| | Bladder Weight (g) | Casing Weight (g) | Total Weight (g) | Length (cm) | Weight per Length (g/cm) |
|---|---|---|---|---|---|
| Weighted Bladder plus Normal Football Casing | | | | | |
| End Portion | 24 | 68.31 | 92.31 | 10.16 | 9.09 |
| Middle Portion | 118.4 | 59.77 | 178.17 | 8.89 | 20.04 |
| Weight/Weight Ratio (Middle/End) | 1.93 | | | | |
| Weight/Length Ratio (Middle/End) | 2.21 | | | | |
| Length/Length Ratio (Middle/End) | 0.88 | | | | |
| Normal Bladder plus Weighted Football Casing | | | | | |
| End Portion | 57.88 | 28.33 | 86.21 | 10.16 | 8.48 |
| Middle Portion | 50.64 | 139.75 | 190.39 | 8.89 | 21.42 |
| Weight/Weight Ratio (Middle/End) | 2.21 | | | | |
| Weight/Length Ratio (Middle/End) | 2.52 | | | | |
| Length/Length Ratio (Middle/End) | 0.88 | | | | |

The weighted footballs and methods of the present disclosure have been described with reference to exemplary embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A sportsball having a major axis and a minor axis;

wherein two planes which are perpendicular to the major axis are located equally distant from the center of the major axis so as to divide the sportsball into a middle portion and two end portions, the middle portion having a middle portion weight and a middle portion length, each end portion having an end portion weight and an end portion length;

wherein the ratio of (middle portion weight/middle portion length) to (end portion weight/end portion length) is at least 2; and wherein the middle portion comprises a plurality of weighted strips surrounding a bladder, the weighted strips being located between the bladder and a casing.

2. The sportsball of claim 1, wherein the ratio of (middle portion weight/middle portion length) to (end portion weight/end portion length) is at least 2.5.

3. The sportsball of claim 1, wherein the middle portion length is from about 2.5 inches to about 3.5 inches.

4. The sportsball of claim 1, wherein the ratio of the middle portion length to one end portion length is from about 0.5 to about 0.95.

5. The sportsball of claim 1, wherein each weighted strip has a uniform thickness along its length and width.

6. A sportsball having a major axis and a minor axis;

wherein two planes which are perpendicular to the major axis are located equally distant from the center of the major axis so as to divide the sportsball into a middle portion and two end portions, the middle portion having a middle portion weight and a middle portion length, each end portion having an end portion weight and an end portion length;

wherein the ratio of the middle portion length to one end portion length is from about 0.5 to about 0.95;

wherein the weight of the middle portion is at least 1.5 times greater than the weight of one end portion; and wherein the middle portion comprises a plurality of weighted strips surrounding a bladder, the weighted strips being located between the bladder and a casing.

7. The sportsball of claim 6, wherein the weight of the middle portion is at least four times greater than the weight of one end portion.

8. The sportsball of claim 6, wherein the weight of the middle portion is from at least two times greater to about five times greater than the weight of one end portion.

9. The sportsball of claim 6, wherein the ratio of (middle portion weight/middle portion length) to (end portion weight/end portion length) is at least 2.

10. The sportsball of claim 6, wherein the middle portion length is from about 2.5 inches to about 3.5 inches.

11. The sportsball of claim 6, wherein each weighted strip has a uniform thickness along its length and width.

12. A football having a major axis and a minor axis;

wherein two planes which are perpendicular to the major axis are located equally distant from the center of the major axis so as to divide the football into a middle portion and two end portions, the middle portion having a middle portion weight and a middle portion length, each end portion having an end portion weight and an end portion length;

wherein the ratio of the middle portion length to one end portion length is from about 0.5 to about 0.95;

wherein the weight of the middle portion is at least 45% of the total weight of the football; and wherein the middle portion comprises a plurality of weighted strips surrounding a bladder, the weighted strips being located between the bladder and a casing.

13. The football of claim 12, wherein the weight of the middle portion is at least 65% of the total weight of the football bladder.

14. The football of claim 12, wherein the weight of the middle portion is at least 70% of the total weight of the football bladder.

15. The football of claim 12, wherein the ratio of (middle portion weight/middle portion length) to (end portion weight/end portion length) is at least 2.

16. The football of claim 12, wherein the middle portion length is from about 2.5 inches to about 3.5 inches.

17. The football of claim 12, wherein the weighted strip has a uniform thickness along its length and width.

18. The sportsball of claim 1, wherein pockets are formed within the bladder, the pockets containing a high-density filler.

19. The sportsball of claim 6, wherein pockets are formed within the bladder, the pockets containing a high-density filler.

20. The football of claim 12, wherein pockets are formed within the bladder, the pockets containing a high-density filler.

* * * * *